United States Patent [19]

Brennan et al.

[11] Patent Number: 4,516,825

[45] Date of Patent: May 14, 1985

[54] MODULAR CONNECTOR FOR TERMINATING EMI/RFI SHIELDED CORDAGE

[75] Inventors: Robert J. Brennan, Ossining; Terrence Meighen, Stormville, both of N.Y.

[73] Assignee: Stewart Stamping Corporation, Yonkers, N.Y.

[21] Appl. No.: 512,375

[22] Filed: Jul. 11, 1983

[51] Int. Cl.[3] ..... H01R 13/658

[52] U.S. Cl. ..... 339/143 R; 339/17 F; 339/99 R

[58] Field of Search ..... 339/14 R, 193 R, 99 R, 339/176 M, 176 MP

[56] References Cited

U.S. PATENT DOCUMENTS 4,424,403 1/1984 Bogese ..... 339/99 R X 4,457,575 7/1984 Davis et al. ..... 339/143 R

*Primary Examiner*—Eugene F. Desmond

*Attorney, Agent, or Firm*—Steinberg & Raskin

[57] ABSTRACT

A modular plug connector is provided with a device for terminating the shielding of a cord to prevent or at least substantially reduce the radiation of electromagnetic and radio frequency interference from the region of the connector, such as when the cord is used in the transmission of high frequency digital-based data. The device also advantageously provides for the isolation and grounding of electrostatic discharge. The shield terminating device in one embodiment is constituted by a contact passing through the housing of the modular plug connector into the cord-receiving cavity of the connector housing so as to electrically engage the shield sheath of the cord.

10 Claims, 10 Drawing Figures

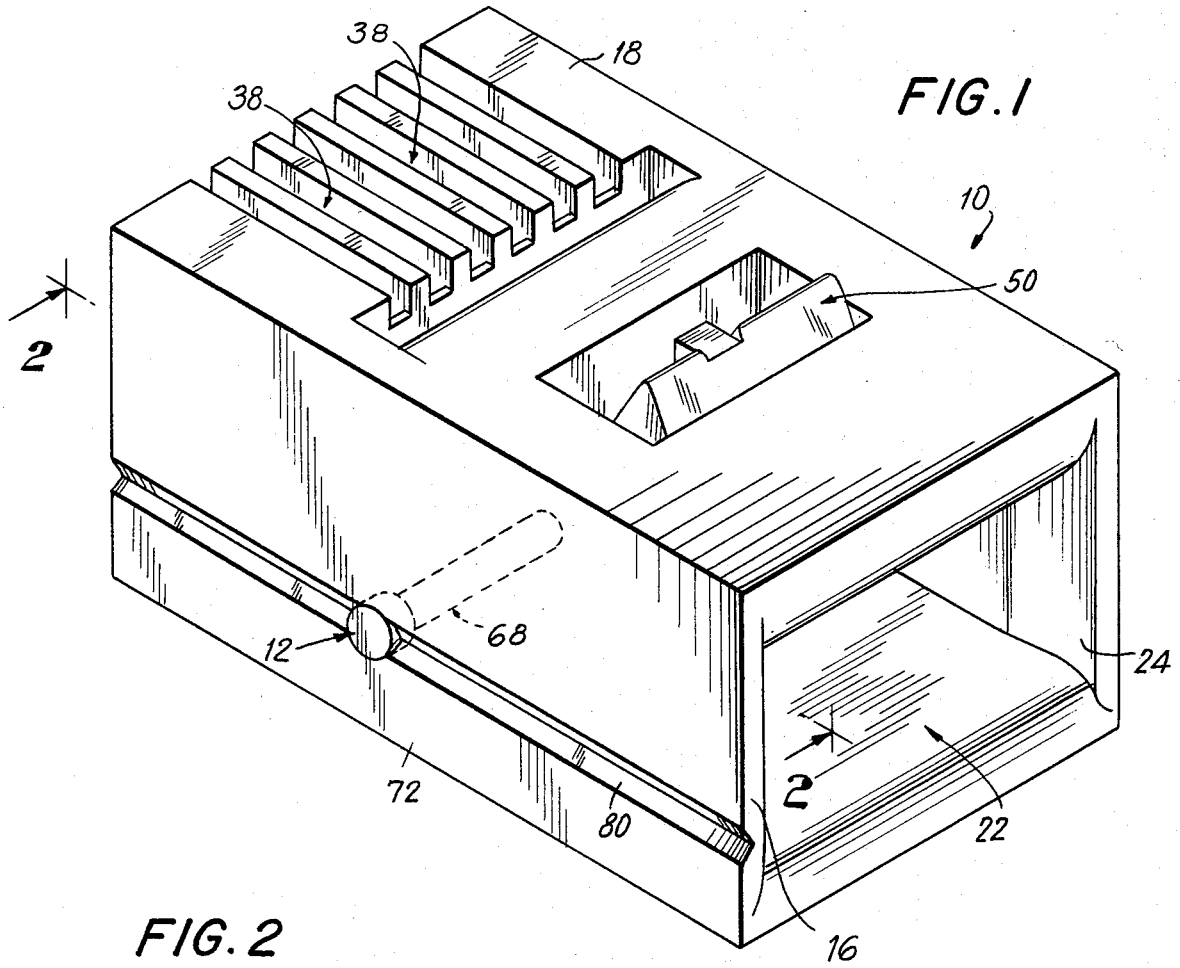
FIG. 1
FIG. 2
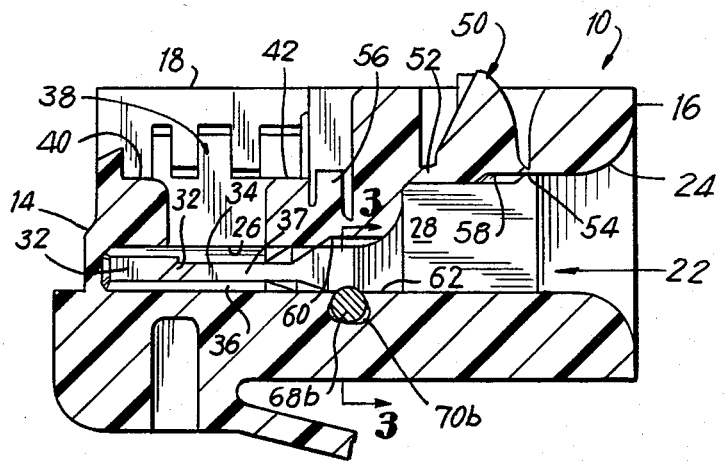
FIG. 3
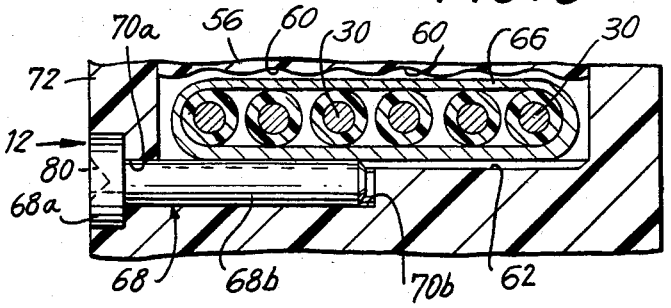

MODULAR CONNECTOR FOR TERMINATING EMI/RFI SHIELDED CORDAGE

BACKGROUND OF THE INVENTION

This invention relates generally to electrical connectors for terminating cords and, more particularly, to so-called modular plug connectors currently being utilized in a top wall of the telephone and data communications industries as well as in other applications.

Modular plug connectors are generally used to terminate both flat and round cords. Generally, a flat cord has a multiplicity of insulated conductors arranged in a spaced linear array within an outer jacket, while a round cord has a multiplicity of insulated conductors arranged in a spiral array within an outer jacket. Various configurations of such connectors are disclosed in various patents assigned to Western Electric Company, Inc., such for example as U.S. Pat. No. 3,699,498 issued Oct. 17, 1972; U.S. Pat. No. 3,761,869 issued Sept. 25, 1983; U.S. Pat. No. 3,860,316 issued Jan. 14, 1975; and U.S. Pat. No. 3,954,320 issued May 4, 1976. Another advantageous configuration of a modular plug connector is illustrated in U.S. Pat. No. 4,211,462 issued July 8, 1980 and assigned to Stewart Stamping Corporation, the assignee of the present application. Although such connectors have been made from two housing components bonded together (see, e.g., U.S. Pat. No. 3,761,869), it appears preferable to manufacture such connectors using a so-called unipartite or integrally molded housing (see, e.g., U.S. Pat. No. 3,998,514).

A modular plug connector generally includes a housing formed of a dielectric material and which defines an internal cord receiving cavity into which the end of a cord is inserted through a cord-receiving aperture formed at one of the housing ends. The cord-receiving cavity includes a jacket-receiving portion adjacent the aperture and a communicating conductor-receiving portion into which the individual insulated conductors, from which the outer jacket has been stripped, are received. A plurality of flat contact terminals, corresponding in number to the number of conductors of the cord, are inserted into individual slots defined in the housing, each terminal being aligned with and electrically engaging a respective conductor. The conductors are generally of tinsel, stranded or solid construction while the terminals have blade-like portions which engage respective conductors in a solderless connection. The flat terminals have edges which are exposed externally of the housing for engagement with respective aligned contact elements provided in a jack socket. The cord end is secured to the connector by jacket anchoring and strain relief portions integrally hinged with the housing and movable against the cord so as to prevent separation of the connector from the cord during customer use as well as to provide strain-relief facilities for the conductors and jacket.

Modular plug connectors of the type described above are presently finding increased use in terminating cords through which digital information is transmitted. For example, modular plug connectors are finding increased use in terminating cordage used in home and office computers for connecting the computers with peripheral components, in data communication applications generally, in electronic games, in telephone communication networks and in similar digital applications.

The present invention is based on the relatively recent recognition that digital technology-based electronic equipment is a major source of electromagnetic (EMI) and radio frequency (RFI) interference, which has become a problem due to the replacement of metal housings by housings formed of plastic material.

In order to prevent or at least substantially reduce the radiation of interference from cordage used in digital-based electronic equipment and to provide at least some protection from interference radiated from extraneous equipment, such cordage has conventionally been provided with "shielding" in the form of a sheath of conductive material between the outer cord jacket and the insulated conductors, the shield sheath enclosing the conductors along their length.

The shielding can be formed of any suitable material, such as aluminum foil having a thickness of about 0.3 mils applied to treated Mylar having a thickness of about 1 mil. Sheaths formed of braided metallic material have also been used in this connection.

When shielded cordage of the type described above is terminated by modular plug connectors, a so-called "drain wire" has conventionally been electrically coupled to the shield at a region proximate to the terminated ends of the cord. The drain wires are grounded to in effect terminate the shielding so that RFI, EMI, and electrostatic electricity conducted through the shield are "drained" to thereby reduce the radiation or discharge thereof.

However, the arrangement described above is not entirely satisfactory. More particularly, it has been found that there is still a tendency for EMI and RFI to be radiated from the cordage in the region at which the modular plug connector is inserted into the jack socket possibly through the space left between the connector and the socket. The problem of leaking signals described above has become quite important and has in fact led to the recent issuance of governmental regulations specifying emission level limitations especially in connection with any electronic device that uses or generates pulses or timing signals at a rate in excess of 10,000 pulses per second. Moreover, since the sheath is a current conductor, there is a danger of an electrostatic discharge (ESD) occurring during operation of the equipment. Such ESD comprises a high voltage discharge which arcs across the contacts of the connector and has the effect of shorting the electronic circuitry when drained using the conventional arrangements described above.

SUMMARY OF THE INVENTION

Accordingly, one object of the present invention is to provide a new and improved modular plug connector for terminating EMI/RFI shielded cordage.

Another object of the present invention is to provide a new and improved modular plug connector for terminating EMI/RFI shielded cordage which effectively reduces or eliminates the radiation of interference from the region at which the modular plug connector is inserted in the jack socket and which protects the cordage from interference radiated by extraneous equipment.

Still another object of the present invention is to provide a new and improved modular plug connector for terminating EMI/RFI shielded cordage wherein the modular plug connector itself serves to terminate the shielding enclosing the cord conductors.

Yet another object of the present invention is to provide a new and improved modular plug connector for terminating EMI/RFI shielded cordage which is economical in manufacture.

A further object of the present invention is to provide a new and improved modular plug connector for terminating EMI/RFI shielded cordage which will effectively drain electrostatic voltage from the shield without the danger of damaging internal circuitry.

A still further object of the present invention is to provide a new and improved modular plug connector for terminating EMI/RFI shielded cordage which will effectively drain ESV and which is economical in manufacture.

Briefly, in accordance with the present invention, these and other objects are attained by providing cord shield terminating means extending through the housing of the modular plug connector wherein respective outer and inner portions of the shield terminating means extend exteriorly of the housing and into the region of the cord receiving cavity defined therein, respectively. According to the preferred embodiment the shield terminating means comprise conductive means adapted to reliably electrically engage with an exposed area of the shield sheath when the end of the cord is secured to the modular connector. When the modular plug connector is inserted into the jack socket, the outer portion of the shield terminating means electrically engages a grounded contact suitably provided in the socket so that the EMI, RFI and electrostatic voltage (ESV) conducted through the shield sheath is conducted to ground thereby preventing the radiation or leakage of EMI and RFI through the spaces between the connector and the jack socket and which prevents discharge of the electrostatic voltage.

In one preferred embodiment, the housing of the modular plug connector is formed of a dielectric material and has walls which define a cord receiving cavity therein into which the end of a flat cord is insertable. The cavity includes a conductor-receiving portion adapted to receive through a cord-receiving aperture a plurality of conductors extending from the end of a shielded cord from which the jacket has been stripped and a jacket-receiving portion adapted to receive the jacketed portion of the cord adjacent the conductors. The conductors are respectively located within parallelly extending troughs formed in the conductor-receiving portion of the cavity which themselves respectively communicate with aligned openings or slots formed in the top wall of the housing adapted to receive flat contact terminals which electrically couple with the respective conductors. At least one and preferably two anchoring members extend transversely across the housing in respective openings which communicate with the cord-receiving cavity and which are integrally connected to the housing through a plastic hinge and a severable web extending between opposed transverse edges of the anchoring members and adjacent walls of the respective openings. The anchoring members each include a surface adapted to engage the cord upon suitable tools urging the same inwardly towards the cord receiving cavity.

According to the preferred embodiment of the invention, a passage is formed through a side wall of the housing opening at the housing exterior and into the cord-receiving cavity. A contact formed of a suitably conductive material is situated in the passage so that an outer portion thereof is exposed at the exterior of the housing and so that an inner portion of the contact extends to at least a slight extent into the cord-receiving cavity, preferably in alignment with one of the anchoring members of the housing.

The shielded cord is inserted into the cord-receiving cavity such that an area of the shield sheath from which the outer cord jacket has been stripped overlies the inner portion of the contact. The aligned anchoring member, when moved into the cord-receiving cavity, forces the exposed shield sheath against the inner portion of the contact to provide a secure electrical engagement therewith. Thus, upon insertion of the cord within the cord-receiving cavity and subsequent inward forcing of the anchoring member, a reliable electrical termination of the shield sheath by the modular plug connector is accomplished. The jack is provided with a suitable ground contact which engages the outer portion of the contact when the connector is inserted into the jack socket to lead the EMI, RFI and ESV from the shield to ground and thereby prevent leakage from the connector.

In another embodiment, the cord shield terminating means are constituted by an open passage formed in the housing providing clear communication between the cord-receiving cavity and the exterior of the connector. The opening is positioned and sized to receive, upon insertion of the connector into the socket, a ground jack contact which engages the shield sheath.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a perspective view of a modular plug connector housing constructed in accordance with one embodiment of the present invention;

FIG. 2 is a longitudinal section view taken along line 2—2 of FIG. 1;

FIG. 3 is a transverse section view taken along line 3—3 of FIG. 2 with the shielded cord inserted within the cord-receiving cavity and prior to the securement of the cord within the housing;

DESCRIPTION OF THE PREFERRED EMBODIMENTS

Figure 4:
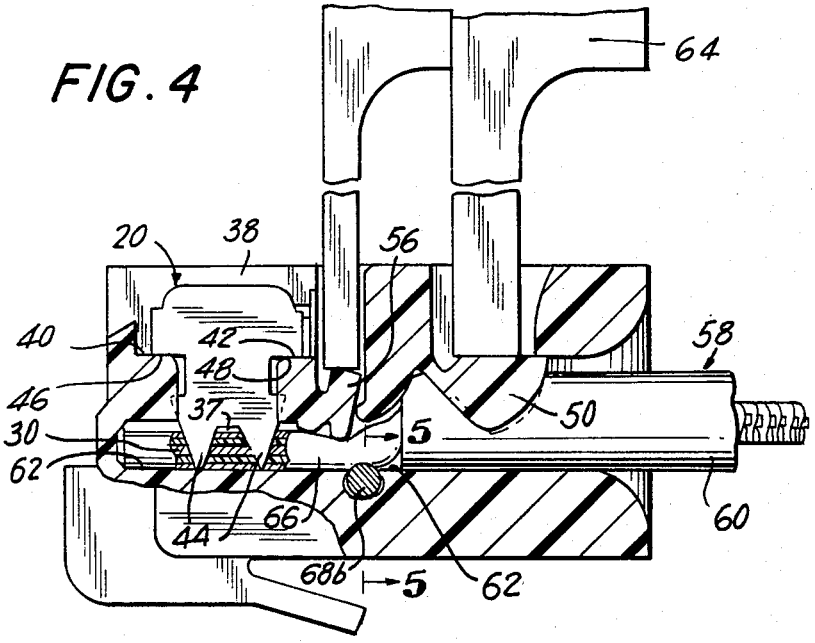
FIG. 4 is a longitudinal section view of a modular plug connector according to the present invention incorporation the housing of FIG. 2 with the shielded cordage inserted within the cord-receiving cavity and wherein the anchoring members of the connector having just been moved by illustrated tooling to secure the cord within the cavity.

Referring now to the drawings wherein like reference characters designate identical or corresponding parts throughout the several views, more particularly to the embodiment of the invention illustrated in FIGS. 1–6, a modular plug connector housing, generally designated 10, is illustrated which has been improved in accordance with the present invention through the incorporation of means for terminating a cord shield, generally designated 12. It is understood that the construction of the housing per se and the connector of which it forms a part are substantially conventional and known to those skilled in the art as that type of modular plug connector finding greatly increasing use not only in connection with the telephone industry but also in virtually all data communication areas.

The incorporation of means for terminating a cord shield in the modular plug connector provides a vast improvement in the shielding which can be obtained against radiation of electromagnetic and radio frequency interference plus ESV from cordage terminated by such modular plug connectors and, therefore, renders such connectors especially suitable for use with digital-based electronic equipment where the radiation of interference at cord connections has become a problem.

The construction of housing 10 of the modular plug connector will be briefly described. It is again noted that such construction is conventional and in this connection reference is made to the above-mentioned U.S. Pat. No. 4,211,462 of Stewart Stamping Corporation which describes this housing construction in greater detail and the disclosure of said patent is hereby incorporated by reference herein. It is of course understood that the invention is not limited to the particular construction of the housing shown and described.

The housing 10 is a rigid unipartite member formed of a suitable dielectric by conventional injection molding techniques. The housing 10 may be made of materials such, for example, as polycarbonate, polyamide, polystyrene, or polyester elastomers or related polymers such as ABS resin. The housing 10 has a closed forward free end 14, a cord receiving rearward end 16, side walls and a top wall 18 in which a plurality of terminal-receiving slots 38 are formed for receiving flat contact terminals 20 (FIG. 4).

The housing 10 defines a longitudinally extending cord-receiving cavity 22 which externally opens through a cord-receiving aperture 24 formed in the rearward end 16 of housing 10. The cord-receiving cavity includes a forward conductor-receiving portion 26 and a rearward enlarged jacket-receiving portion 28. The cavity 22 substantially encloses the entire end section of the cord with the terminal end portions of the conductors (having the jacket stripped therefrom) being received in the conductor-receiving portion 26 and the adjacent jacketed portion of the cord being received within the jacket-receiving portion 28. It is important to precisely locate the cord conductors 30 (FIGS. 3–5) so that they are in direct aligned relationship with respective slots formed in the terminal receiving side 18 which receive respective flat contact terminals 20. For this reason partitions 32 and upper and lower ridges 34–36 extend through the conductor-receiving portion 26 to guide the end regions of respective conductors 30 into corresponding conductor troughs 37.

A plurality of parallely spaced, longitudinally extending slots 38 are formed through the terminal-receiving top wall 18 of housing 10, each slot 38 being aligned over a respective one of the conductor-receiving troughs 37. A pair of inwardly extending shoulders 40 and 42 (FIG. 2) are situated at about the mid-height of each slot 38. Each slot 38 is dimensioned so as to snugly receive a respective flat contact terminal 20 as described below.

Referring to FIG. 4, each terminal 20 is constructed of an electrical conductive material, such as gold plated phosphor bronze. The terminal 20 has a flat conductor portion including a pair of insulation-piercing tangs 44. Each of the terminals are formed with a pair of outwardly extending shoulders 46 and 48. When a terminal 20 is inserted into an associated terminal-receiving slot 38, the points of tangs 44 of each terminal penetrate through a respective conductor 30 and become embedded in the lower wall 62 of the conductor-receiving portion 26 prior to terminal shoulders 46 and 48 engaging shoulders 40 and 42.

The housing 10 is also constructed with means for both securing the connector to the cord and for providing strain relief for the jacket and conductors. A jacket anchoring member 50 is integrally connected to housing 10 through a plastic hinge 52 (FIG. 2) and initially by a frangible portion 54 which supports the jacket anchoring member 50 in its initial position shown in FIG. 2 when a cord is receivable within cavity 22. The frangible portion 54 is constructed so as to shear upon the application of an inwardly directed force thereon by a suitable tool so that the jacket anchoring member can pivot about hinge 52 to engage the cord jacket. A conductor-anchoring member 56 is formed forwardly of the jacket-anchoring member 50 and extends transversely over the entire width of the conductor-receiving portion 26 of cavity 22. The conductor-anchoring member 56 is integrally connected to the housing 10 along its forward and rearward sides. The surfaces of the jacket and conductor anchoring members 50 and 56 may be formed with a plurality of parallel concave channels 58 and 60 respectively which advantageously enhance the securement of the cord in the housing as described in U.S. Pat. No. 4,211,462.

Prior to describing the improvement of the present invention, a typical assembly of the modular plug connector and securement to a cord will be described. Referring to FIG. 4, the end of a cord 58, which is shielded in a manner described below, is inserted through aperture 24 into the cord-receiving cavity 22 of housing 10. A certain length of the jacket 60 is stripped from the cord 58 so that as the cord is fully inserted into the cavity 22, respective insulated conductors 30 are separated and guided into respective troughs 37 aligned with respective terminal-receiving slots 38 and such that the conductors pass below the conductor-anchoring member 56. Terminals 20 are inserted into respective slots 38 and driven towards the conductors so that the tangs 44 of each terminal 20 penetrate the insulation of each conductor thereby making electrical connection therewith and until the points of the tangs become embedded in the bottom wall 62 and terminal shoulders 56 and 58 engage housing shoulders 40 and 42. The jacket and conductor-anchoring members 50 and 56 are driven into the conductor-receiving cavity by means of a suitable tool 64 (FIG. 4). The frangible portion 54 shears so that the jacket-anchoring member 50 pivots into engagement with the jacket 60 and cord 58 to provide a reliable mechanical securement of the cord to the connector. Similarly, one of the integral connections of the conductor-anchoring member 56 to the housing is sheared and the conductor-anchoring member moves against the conductors 30 to provide strain relief for the conductors. The anchoring members are locked in the cord-engaging positions shown in FIG. 4 by suitable locking structure provided in the housing 10 as described in U.S. Pat. No. 4,211,462.

The construction and assembly of the modular plug connector and termination of the cord thereby described above is conventional. The improvement according to the present invention is described below.

In accordance with the present invention, the modular plug connector is provided with means for terminating the shielding sheath of a cord so that electromagnetic and radio frequency interference conducted through the shield sheath can be conducted through the connector to a grounded contact in the socket. Generally, the cord shield terminating means extends through the housing of the modular plug connector such that respective inner and outer portions thereof extend exteriorly of the housing and into the region of the cord-receiving cavity respectively.

Figure 5:
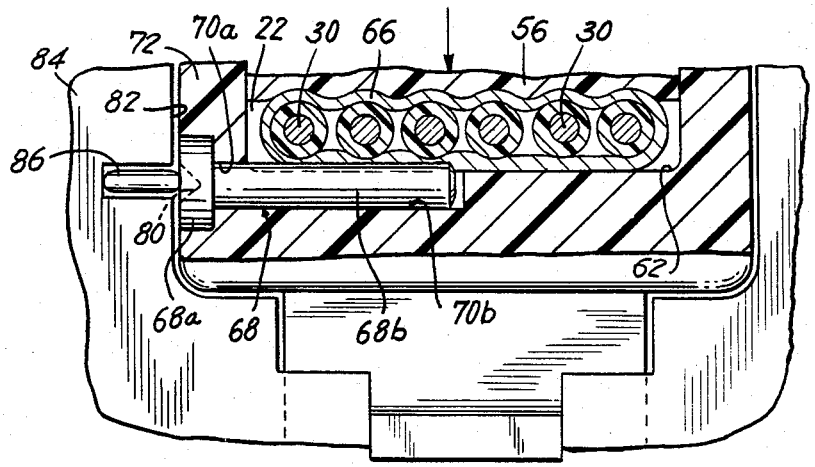
FIG. 5 is a section view taken along line 5—5 of FIG. 4.

Referring to FIGS. 3–5, the shielded cord 58 comprises the plurality of insulated conductors 30 within the jacket 60. In order to prevent radiation of interference from the cord 58, such as when the conductors transmit high frequency digital information, a shielding in the form of a sheath 66 of conductive material, such as aluminum foil or the like, encloses the insulated conductors 30 along their length. Such shielding is of course conventional.

In the embodiment of the invention illustrated in FIGS. 1–6, the cord shield terminating means, generally designated 12, is constituted by a contact 68 formed of electrically conductive material, such as gold plated phosphor bronze, which extends through a passage 70 which opens to the housing exterior and into the cord-receiving cavity 22 of the modular plug connector. In particular, the passage 70 is formed by an opening 70*a* in a side wall 72 of housing 10, the opening 70*a* continuing in the form of a channel 70*b* which extends transversely through the bottom wall 62. The transverse channel 70*b* opens along its length into the cord-receiving cavity 22. The opening 70*a* includes an enlarged diameter portion countersunk within the side wall 72 which receives an enlarged head 68*a* of the contact 68. In the illustrated embodiment, the contact 68 is in the shape of a pin-type member.

Figure 6:
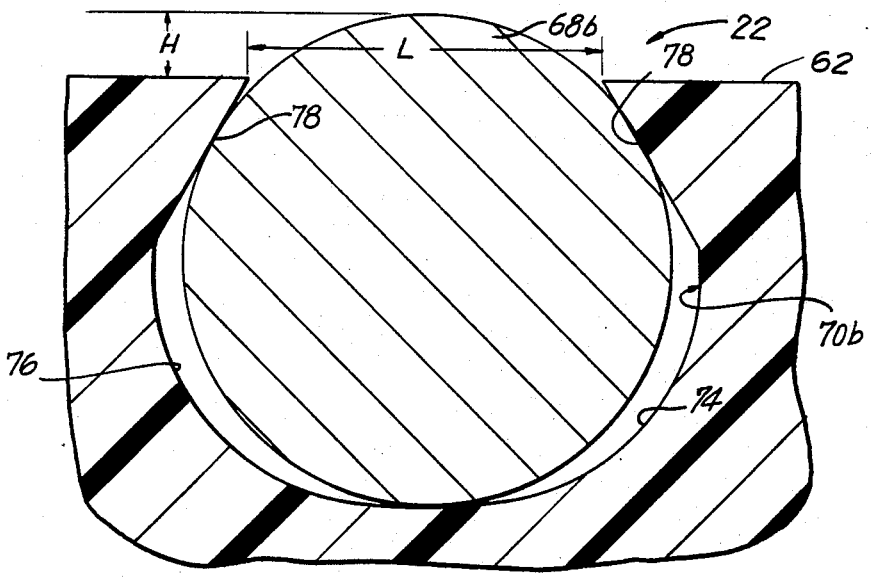
FIG. 6 is an enlarged section view of the particular conductive shield terminating means constituting a component of the embodiment of the modular plug connector of FIGS. 1–5.

The diameter of the shank 68*b* of contact 68 is chosen to be sufficiently large such that when the contact is situated in the passage 70, preferably by an interference fit, an upper cylindrical segment of the contact shank 68*b* extends above the plane of the bottom wall 62 and protrudes into the cord-receiving cavity 22 as best seen in FIG. 6.

In the illustrated embodiment of FIGS. 1–6 and as best seen in FIG. 6, the channel 70*b* has a longitudinal cross-section defined by a pair of arcuate segments 74 and 76 and a pair of inwardly extending linear segments 78 forming a throat through which the protruding cylindrical segment of the contact extends. This configuration facilitates insertion of the contact 68 into the passage 70 with an interference fit while preventing the shank 68*b* of contact 68 from working loose from the channel 70*b*. As noted above, the diameter of the contact shank 68*b* is chosen so that an upper cylindrical segment thereof protrudes into the cord-receiving cavity and as best seen in FIG. 3, the contact extends to about the mid-region of the transverse dimension of the cord-receiving cavity.

Still referring to FIG. 6, typical dimensions of the components may be as follows: the diameter D of the contact shank is about 0.032 inches, the linear length L of the cylindrical segment of the contact shank which extends or protrudes into the cord-receiving cavity is about 0.023 inches and the height H of the protruding cylindrical segment of the contact is about 0.004 inches.

A longitudinal groove 80 (FIG. 1) is formed in the outer surface of the housing side wall 72 and intersects the head 68*a* of contact 68 for purposes described below.

With the improved construction of the modular plug connector described above, it will be seen that the termination of the shielded cord in the manner described above will simultaneously provide a termination of the shielding sheath so that EMI, RFI and ESV conducted through the shield sheath can be conducted through the modular plug connector to a ground contact in the socket. More particularly, prior to the termination of the cord, the jacket 60 is stripped from the end of the cord 58 so as to leave a length of the shielded sheath 66 (FIG. 4) at the region of the cord-receiving cavity 22 immediately rearward of the troughs 37 defined by partitions 32 and ridges 34 and 36 overlying the shank 68*b* of contact 68. As seen in FIG. 3, prior to driving the conductor-anchoring member 56 to its locking position shown in FIG. 4, the sheath rests against the protruding cylindrical segment of the contact shank 68*b* and is situated beneath the conductor-anchoring member 56.

The terminals 20 are inserted as described above and the jacket and conductor-anchoring members 50 and 56 are driven to their locking position by the tools 65. As seen in FIGS. 4 and 5, the downward movement of the conductor-anchoring member 56 not only provides strain relief for the conductors and sheath but additionally serves to force the sheath 66 firmly into engagement with the protruding cylindrical segment of the contact shank 68*b* thereby insuring a reliable electrical communication between the contact 68 and the sheath 66.

The modular plug connector is thus secured to the end of the cord and is inserted into the socket 82 of a jack 85 as seen in FIG. 5. It is of course understood that the other end of the cord may be similarly terminated. The jack 84 is conventional in that it is provided with a linear array of contacts (not shown) adapted to engage the upper edges of respective contact terminals 20 through the upper regions of slots 38 to effect an electrical connection. However, the jack 85 is also provided with a grounded contact 86 adapted to be received and guided within the groove 80 formed in the side wall 72 as the modular plug connector is inserted into the socket 82. When the modular plug connector has been fully inserted into the socket, the grounding contact 86 engages the head 68*a* of contact 68.

It will be readily understood from the foregoing that electromagnetic radio frequency interference and ESV conducted in the shield sheath 66 will be conducted through the modular plug connector by the contact 68 and through the jack contact 86 to ground. In this manner, the possibility of interference leakage from the region of the connector is effectively eliminated. The construction is extremely economical in manufacture and eliminates the need for the conventional "drain wire". The electrical contact between the shield sheath and the contact is reliably maintained by the positioning of the contact in opposed relationship to the conductor-anchoring member so that when the conductor-anchoring member is driven to its locked position to provide strain relief as is conventional, it also forcibly forces the shield sheath against the conductive contact.

Figure 9:
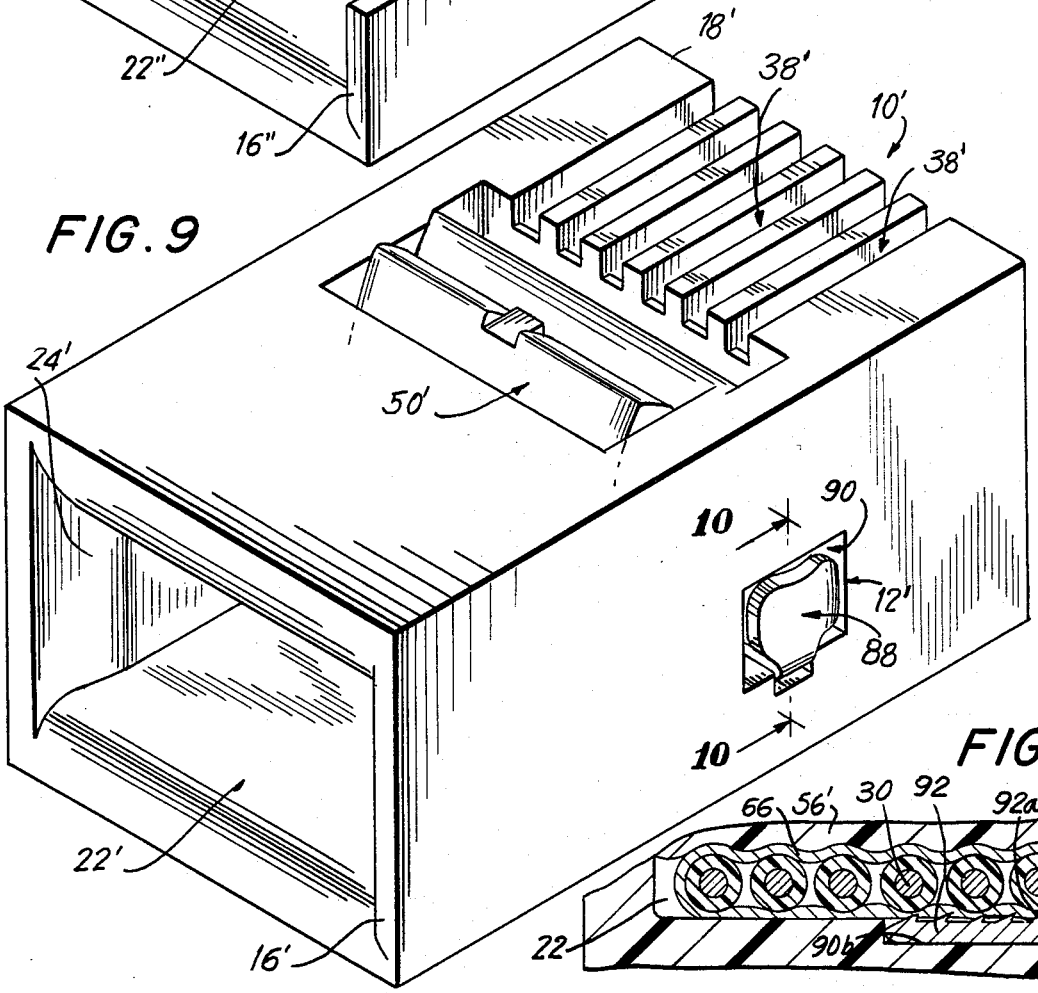
FIG. 9 is a perspective view of still another embodiment of a modular plug connector housing in accordance with the invention and showing another form of the conductor shield terminating means inserted in position.
Figure 10:
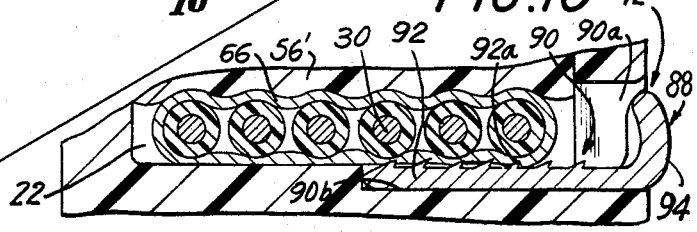
FIG. 10 is a section view taken along line 10—10 of FIG. 9 with the shielded cord secured within the connector.

Referring now to the embodiment illustrated in FIGS. 9 and 10 wherein elements corresponding to those described above in connection with the embodiment of FIGS. 1–6 have been designated by the same reference numerals, primed, the cord shield terminating means 12' is constituted by a strip member 88 formed of an electrically conductive material which extends through a passage 90 which opens to the housing exterior and into the cord-receiving cavity 22 of the modular plug connector. The strip member 88 comprises a shank portion 92 having a plurality of barbs 92*a* formed in its upwardly facing surface and a bent head portion 94 adapted to close the opening 90*a* of passage 90 and which protrudes somewhat to the exterior of the housing 10'. The channel portion 90*b* of passage 90, which may be shallower than the channel 70*b* of passage 70, receives the shank portion 92 of the strip member 88. When the conductor-anchoring member 56' is driven to its locked position as seen in FIG. 10, the sheath 66 electrically communicates with the strip member 88. Removal of the strip member 88 from the passage 90 is prevented through the penetration of the barbs 92*a* in the sheath 66. Accordingly, an interference fit is not required in this embodiment. The grounded jack contact is adapted to electrically engage the head portion 94 of the strip member 88 when the modular plug connector is inserted into the jack socket.

Figure 7:
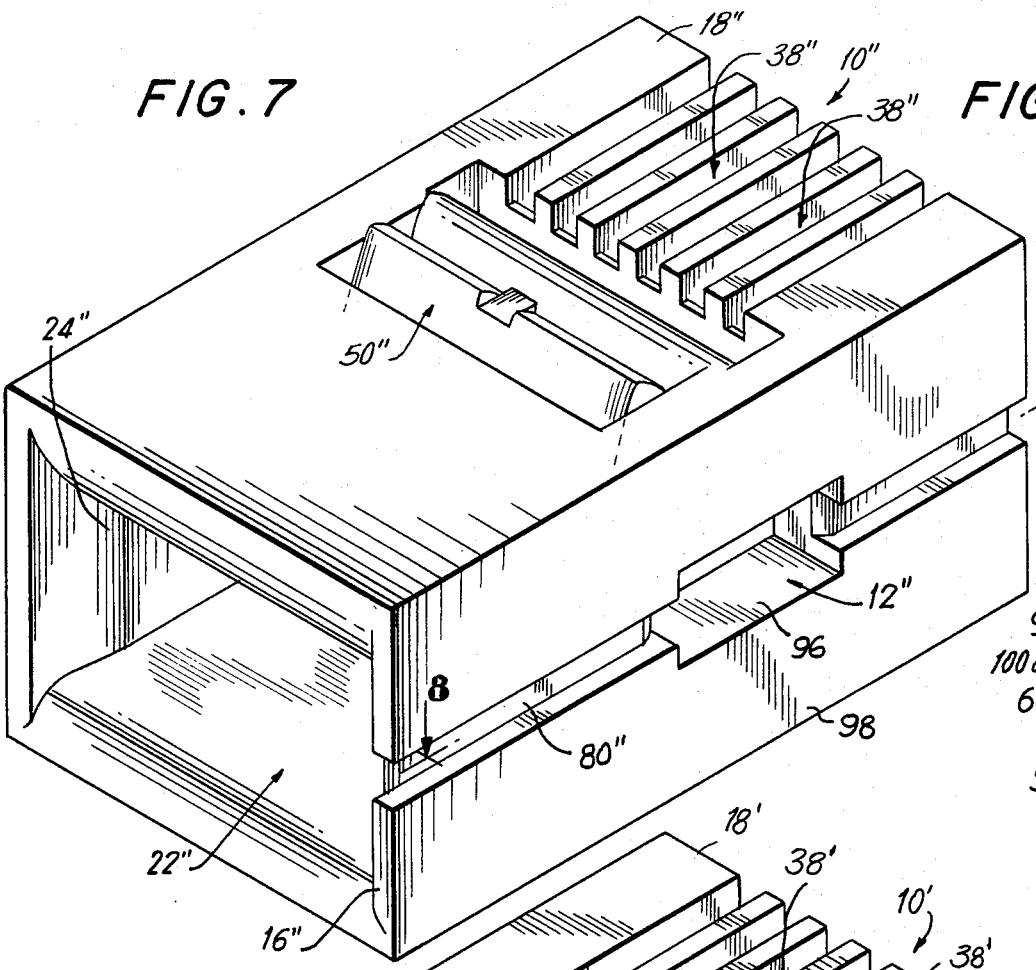
FIG. 7 is a perspective view of another embodiment of a modular plug connector housing in accordance with the present invention.
Figure 8:
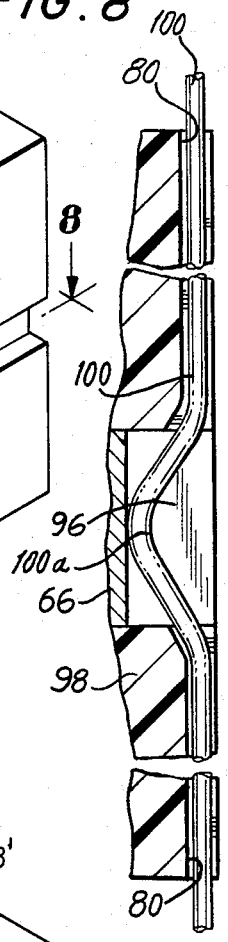
FIG. 8 is a section view taken along line 8—8 of FIG. 7 and illustrating the completed connector inserted within a jack socket.

Referring now to the embodiment illustrated in FIGS. 7 and 8, and wherein components corresponding to like components in the embodiment of FIGS. 1–6 are designated by the same reference numeral, double primed, the cord shield terminating means 12" comprises an aperture 96 formed in the side wall 98 of the modular plug connector housing 10" which extends through the side wall 98, respective outer and inner ends of the aperture 96 opening exteriorly of the housing and into the region of the cord-receiving cavity defined there, respectively. The aperture 96 has a relatively longitudinally elongated configuration and is aligned with a guide groove 80" formed in side wall 98.

In this embodiment, the grounded jack contact, designated 100 in FIG. 8, is formed with a bent contact portion 100*a* which is adapted to be received in and pass through the aperture 96 when the modular plug connector is fully inserted into the jack socket. In this manner, the contact portion 100*a* of jack contact 100 makes direct electrical contact with the shield sheath 66 to conduct any electromagnetic and radio frequency interference conducted through the sheath to ground. Although this embodiment is somewhat more economical in manufacture than the previously described embodiments, it is not as preferred since the aperture 96 provides access to the cord-receiving cavity through which contaminants may enter.

The present invention thus provides cord shield terminating means which extend through the housing of a modular plug connector by which a shield sheath is terminated through the connector itself to prevent leakage of radiation from the region of the connector. The modular plug connector according to the present invention is especially suited for terminating cords which transmit digital based electronic data.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A modular plug connector for terminating a shielded cord having a plurality of insulated conductors enclosed within an outer jacket and a shield sheath between the jacket and conductors and enclosing the latter substantially along their length, comprising: a dielectric housing having a top wall and side walls defining a forward free end and a rearward cord input end having an aperture formed therein opening into a longitudinally extending cord-receiving cavity formed within the housing, said cord-receiving cavity having a forward conductor-receiving portion and a rearward jacket-receiving portion, a plurality of slot-like openings formed through said housing top wall adapted to receive flat contact terminals, each of said openings being aligned with a corresponding conductor upon termination of a cord; and means formed of electrically conductive material extending through at least one of said housing side walls for terminating the cord shield sheath, said cord shield sheath terminating means having an inner portion situated in said cord-receiving cavity extending transversely therein adapted to make electrical contact with the cord shield sheath and an outer portion situated externally of said housing.

2. The combination of claim 1 wherein said electrically conductive shield sheath terminating means are situated in a passage formed in said housing side wall, said passage opening into said cord-receiving cavity and to the exterior of said housing.

3. The combination of claim 2 wherein said electrically conductive means are constituted by a contact formed of electrically conductive material, said contact being situated in said passage with at least a part of an inner portion thereof protruding into said cord-receiving cavity and an outer part thereof being exposed to the exterior of said housing.

4. The combination of claim 3 wherein said contact comprises a pin-shaped member.

5. The combination of claim 3 wherein said passage includes an opening in said housing side wall and an aligned channel formed in a bottom wall of said cord-receiving cavity, said channel opening at a throat region into said cord-receiving cavity and extending substantially transversely over at least a part of said cord-receiving cavity.

6. The combination of claim 5 wherein said contact has a substantially cylindrical shank portion, and wherein a cylindrical segment of said shank portion extends through said throat region and protrudes into said cord-receiving cavity.

7. The combination of claim 6 further including a longitudinal groove formed in said housing side wall in alignment with said outer portion of said contact.

8. The combination of claim 2 wherein said housing further includes at least one movable member extending transversely across one of said housing walls and connected thereto for movement from an unlocking position to a locking position wherein a surface thereof is located at least partially within said conductor-receiving portion of said cord-receiving cavity, and wherein said inner portion of said cord shield sheath terminating means is situated in substantially opposed relationship to said anchoring member, whereby when said movable member is moved to said locking position it serves to urge the sheath into secure electrical contact with said shield sheath terminating means.

9. The combination of claim 2 wherein said shield sheath terminating means are constituted by a strip member formed of electrically conductive material, said strip member being situated in said passage with at least an inner portion thereof protruding into said cord-receiving cavity and an outer part thereof being exposed to the exterior of said housing.

10. The combination of claim 9 wherein barb means for penetrating said shield sheath are provided on said inner portion of said strip member.

* * * * *